United States Patent [19]

Cartwright

[11] Patent Number: 4,609,415

[45] Date of Patent: Sep. 2, 1986

[54] ENHANCEMENT OF EMULSIFICATION RATE USING COMBINED SURFACTANT COMPOSITION

[75] Inventor: Richard V. Cartwright, Sussex, N.J.

[73] Assignee: Hercules Incorporated, Wilmington, Del.

[21] Appl. No.: 572,096

[22] Filed: Jan. 19, 1984

[51] Int. Cl.[4] ..... C06B 45/00

[52] U.S. Cl. ..... 149/2; 149/21; 149/45; 149/46; 149/61; 149/76; 149/77; 252/356; 252/357

[58] Field of Search ..... 252/356, 357; 149/2, 149/21, 45, 61, 76, 77

[56] References Cited

U.S. PATENT DOCUMENTS

| | | | |
|---|---|---|---|
| 3,161,551 | 4/1961 | Egly | 149/46 |
| 3,447,978 | 8/1967 | Bluhm | 149/2 |
| 4,111,727 | 9/1977 | Clay | 149/2 |
| 4,141,767 | 3/1978 | Sudweeks et al. | 142/2 |
| 4,338,146 | 10/1979 | Granlund | 149/109.6 |
| 4,356,044 | 3/1981 | Jessop et al. | 142/2 |
| 4,357,184 | 11/1982 | Binet et al. | 149/87 X |
| 4,453,989 | 6/1984 | Mullay | 149/60 X |
| 4,459,213 | 7/1984 | Uchida et al. | 252/2 X |

*Primary Examiner*—Stephen J. Lechert, Jr.
*Attorney, Agent, or Firm*—John E. Crowe

[57] ABSTRACT

Method for facilitating the formation and stability of invert water-in-oil emulsion blasting agents by use of a combination of certain surfactants; and corresponding formulations.

25 Claims, No Drawings

ENHANCEMENT OF EMULSIFICATION RATE USING COMBINED SURFACTANT COMPOSITION

The present invention relates to an emulsifier system and method for facilitating the rapid formation of stable invert water-in-oil emulsion blasting agents by use of a combination of certain surfactants.

BACKGROUND

Within the last ten years there has been a substantial movement away from the use of older traditional explosive compositions such as TNT, dynamite, and nitroglycerin as blasting agents for hard rock mining, excavation, and similar commercial purposes, in favor of a readily available prilled ammonium nitrate (AN) or mixtures of ammonium nitrate with other similar oxidizer salts, plus various organic and inorganic fuels.

Such explosive formulations use relatively cheap components, can be produced or constructed "in situ", and are much safer compared with traditional explosives since no long term storage or transportation is generally required.

Where an intended bore hole is deep and/or wet, however, AN and ANFO formulations are easily desensitized and must be protected (a) by special packaging, (b) by the addition of expensive AN coatings, and (c) by thickeners or gelling agents, and the like. Moreover, ANFO has somewhat limited blasting energy due to its low bulk density.

Some of the above problems can be avoided, in part, by use of special slurries having a higher bulk density, but such formulations are usually not moisture proof, and still must rely upon gassification or other means to retain an acceptable level of sensitivity. Pressure conditions at the bottom of deep bore holes, however, may compress gas voids, which can result in temporary non-detonatable conditions, leaving partial or residual unexploded charges in areas where further drilling, mining or excavation may be required.

A substantial breakthrough with respect to moisture resistance is described in U.S. Pat. No. 3,161,551 of Egly, in which a water-resistant blasting agent is obtained having at least one solid prilled inorganic salt (e.g. ammonium nitrate), treated with a 50–70% AN solution in the form of an aqueous invert emulsion containing a fuel oil and a long chain fatty acid or derivative thereof as the continuous hydrophobic phase.

Egly's composition exhibits substantial resistance to water because of the fact that the water-in-oil emulsion fills most of the natural voids in the solid prilled AN salt component, and water cannot easily force its way through the continuous external hydrophobic phase of the emulsion. Sensitivity problems remain, however, when deep-hole blasting is desired.

Bluhm (U.S. Pat. No. 3,447,978) also describes a class of explosive slurry compositions generally falling within the category of water-in-oil emulsion blasting agents, what consist of a discontinuous AN aqueous phase (optionally supplemented by other water soluble oxidizer salts) in a continuous phase consisting of a carbonaceous fuel having a predetermined gas-retaining consistency at 70° F., plus voids, inclusive of an occluded gas component such as air and glass bubbles, plus a standard water-in-oil emulsifier.

Bluhm's compositions, while capable of avoiding some of the above-enumerated deep wet-hole problems, are often difficult to prepare at the hole without substantial agitation, despite the use of art-recognized water-in-oil type emulsifiers.

Emulsifying agents found usable in Egly and Bluhm include fatty acid derivatives as listed, for instance, in U.S. Pat. Nos. 3,161,551, 3,447,978, 3,765,964, 4,110,134 and UK No. 1,306,546. Based on such background disclosure, it may be generally assumed that sorbitan fatty esters such as sorbitan oleates are preferred in the art for obtaining stable invert emulsions but at considerable sacrifice, timewise. For comparison purposes, however, emulsifiers can also include faster acting nitrogen-containing surfactants such as ammonium salts as exemplified in U.S. Pat. Nos. 4,026,738 and 4,141,767, unsaturated fatty bis(hydroxyethyl) oxazolines (e.g. U.S. Pat. Nos. 4,216,040, 4,322,258), fatty 1-hydroxyethyl-2-imidazolines (e.g. U.S. Pat. No. 4,315,784) and sodium N-methyl-N-alkyl (beef tallow) Taurate (e.g. U.S. Pat. No. 4,315,787). The increased efficiency of the N-containing compounds, however, is usually more than offset by loss in emulsion stability.

Due to the above-indicated slowness of the fatty acid esters and the concurrent real need for pressure and water-resistant properties, it has frequently become necessary to resort to lengthy and severe agitation to form a stable invert emulsion. This, in turn, however limits options such as use of glass bubbles, sintered microspheres or similar density control components due to both physical and chemical instability of such formulations when exposed to substantial shearing forces.

It is an object of the present invention to increase the utility of invert emulsion blasting agents, particularly emulsions utilizing glass bubbles or similar void-maintaining additive material as density control agents, when produced, in situ, using simple equipment.

It is a further object of the present invention to more easily form stable water-in-oil emulsion blasting agents, using a limited amount of agitation.

THE INVENTION

The above objects are obtained in accordance with the present invention whereby an invert emulsion blasting agent obtained by admixing (a) an oil phase containing a sorbitan fatty acid ester emulsifier in a hydrocarbon solvent and (b) an aqueous phase containing at least one water soluble inorganic oxidizer salt, whereby the blasting agent is modified by precombining said sorbitan ester emulsifier with an active amount of a nitrogen-containing surfactant such as one or more of a fatty acid amide, a fatty amine or corresponding salts thereof in which the corresponding hydrocarbon group thereof is a straight chain having about 10–20 carbon atoms.

A suitable oil phase solvent for purposes of the present invention comprises one or more of a normal or branched aliphatic, alicyclic or aromatic hydrocarbon which may be saturated or unsaturated so long as it is capable of dissolving both hydrophobic emulsifier components and is maintainable in liquid form during preparation. Preferred solvents include, for instance, benzene, nitrobenzene, toluene, xylene, petroleum distillates and by-products such as gasoline, kerosene and diesel fuels inclusive of No. 2 fuel oil, also tall oils, waxes, and paraffin oils or mixtures thereof. Concentration-wise the above-described oil phase hydrocarbon solvent is usefully present in about 3–20 weight percent and preferably 5–10 weight percent, based on total emulsion.

Included within the above-described oil phase and preferably in premixed condition are the sorbitan fatty acid ester and nitrogen-containing surfactant components, neither of which individually exhibit a combined high emulsification rate in conjunction with excellent stability.

The emulsifier for purposes of the present invention is usefully present in an invert emulsion blasting agent in an amount of about 0.6–7.0 weight percent or higher, of which, an active amount of nitrogen-containing surfactant component comprises not less than about 0.1 weight percent, usefully about 0.1–2 weight percent or higher, and preferably about 0.2–1 weight percent, based on the emulsion.

The emulsifier system itself usefully comprises in combination (A) at least one sorbitan fatty acid ester; (B) an active amount of a nitrogen-containing surfactant; and (C) organic solvent comprising a normal or branched hydrocarbon, inclusive of an alicyclic or aromatic hydrocarbon, preferably having a ratio by weight of (A)-to-(B) components of about 10–1 to 0.1–1.0.

The sorbitan ester component(s) is present in sufficient amounts in each case to achieve reasonable long-term stability coupled with minimal exposure to shearing effects, preferably at a concentration of about 0.5–5 weight percent. Such a component usefully includes one or more of a sorbitan sesquioleate, sorbitan laurate, sorbitan oleate, sorbitan palmitate or sorbitan stearate, inclusive of both the mono and polysubstituted fatty acid derivatives.

Specific examples of suitable nitrogen-containing surfactant, for purposes of the present invention, include one or more of hydrogenated tallowamine, oleylamine, dodecylamine, cocoamine, coco monoethanolamide, coco diethanolamide, linoleic diethanolamide, oleic diethanolamide, stearic diethanolamide, and corresponding salts thereof.

The aqueous phase of the present invention usefully comprises about 5–30 and preferably 10–20 weight percent water, based on total emulsion, containing 50–95% by weight of at least one oxidizer salt, comprising one or more of ammonium nitrate, sodium chlorate, sodium perchlorate, calcium nitrate, calcium chlorate, calcium perchlorate, potassium nitrate, potassium chlorate, potassium perchlorate, ammonium chlorate, ammonium perchlorate, lithium nitrate, lithium chlorate, lithium perchlorate, magnesium nitrate, magnesium chlorate, aluminum chlorate, barium nitrate, barium chlorate, barium perchlorate, zinc nitrate, zinc chlorate and zinc perchlorate.

While the utilization of an active amount of nitrogen-containing surfactant with the sorbitan ester, as above defined, substantially increases the rate of formation of a number of invert aqueous emulsion blasting agents using simple equipment at the hole, it is nevertheless found convenient to construct blasting agents of the above type under optimal conditions wherever possible.

For such purpose, and as above noted, it is necessary that the oil and aqueous phase be liquid during preparation, the emulsification preferably being carried out at a temperature range of about 50° C.–90° C.

In addition, it is found convenient to employ a propeller stirrer, a rotor-stator homogenizer, colloid mill, or similar standard agitating devices, although such use can generally be limited to about ½ to 1/10 of the time normally expected when using the fatty acid ester alone, under otherwise similar conditions. In any case the shorter period is preferred when void-forming filler material such as glass, perlite or similar plastic microspheres, such as Microperl GT-25 etc. are included as additives because of inherent sensitivity to severe agitation on the part of such compositions.

Timewise, for example, this can be translated into treatment on a rotor-stator homogenizer for 4–60 seconds as opposed to the usual 80–180 second period or more.

The following examples further illustrate embodiments of the present invention in which all percentages are by weight.

EXAMPLE 1

Test emulsions identified hereafter as S-1 through S-10 and controls C-1 through C-4 are prepared by premixing No. 2 fuel oil with sorbitan sesquioleate as emulsifier in combination with varying amounts of the indicated nitrogen-containing surfactants under substantially identical agitation and temperature (77° C.) conditions. To this solution is added hot ammonium nitrate solution (83%) under the same substantial agitation* and temperature-control conditions, the time required for emulsion formation being observed and recorded in Table I infra as a direct measure of the effectiveness of the emulsifier/surfactant system used.

*Tekmar Super Dispax Homogenizer (SD-45) from Tekmar Corporation at a speed setting of 65.

EXAMPLE 2

Test emulsions identified as S-11 through S-13 and Control C-5 are prepared again using No. 2 fuel oil as organic solvent with substantial amounts of sorbitan sesquioleate as emulsifier plus indicated active amounts of commercially available oleyl amines and an amide as surfactants using a slow speed propeller mixer **.

**Jiffy Mixer Model ES from Jiffy Mixer Company, Inc.

The aqueous phase, in this case, consists of a stirred heated (82° C.) solution of ammonium nitrate, sodium nitrate and water.*** To the premixed oil phase is added about ⅓ of the volume of the aqueous solution, with agitation at 400 rpm for 1 minute, then alternately at 200 rpm for 3 minutes and 600 rpm for one minute, until a visible thickening is noted. After formation of emulsion, the remaining aqueous solution is added at 600 rpm and thereafter stirred for 10 minutes at 750 rpm to assure suitable particle size.

***$4420_g$ $NH_4NO_3$, 1331 g. $NaNo_3$, 1402 g, HOH

Time required for initial formation of an emulsion is reported in Table II infra.

TABLE I

| Sample Example No. | Weight of No. 2 Fuel Oil, (g) | Weight of Sorbitan Sesquioleate*1 (g) | N—Containing Surfactant Type | Weight (g) | Emulsion Appearance Time (Minutes) |
|---|---|---|---|---|---|
| S-1 | 13.4 | 4.8 | n-dodecylamine | 1.0 | 0.3 |
| S-2 | 12.4 | 4.8 | n-dodecylamine | 2.0 | 0.1 |
| S-3 | 13.4 | 4.8 | hydrogenated tallowamine acetate*2 | 1.0 | 0.8 |
| S-4 | 12.4 | 4.8 | hydrogenated tallowamine acetate*2 | 2.0 | 0.3 |

TABLE I-continued

| Sample Example No. | Weight of No. 2 Fuel Oil, (g) | Weight of Sorbitan Sesquioleate*[1] (g) | N—Containing Surfactant Type | Weight (g) | Emulsion Appearance Time (Minutes) |
|---|---|---|---|---|---|
| S-5 | 13.4 | 4.8 | tallowamine (c)*[3] | 1.0 | 1.0 |
| S-6 | 13.4 | 4.8 | cocoamine (d)*[4] | 1.0 | .2 |
| S-7 | 12.4 | 4.8 | cocoamine (d)*[4] | 2.0 | .1 |
| S-8 | 13.4 | 4.8 | oleic diethanolamide*[5] | 1.0 | 1.0 |
| S-9 | 12.4 | 4.8 | oleic diethanolamide*[5] | 2.0 | .3 |
| S-10 | 12.4 | 4.8 | fatty alkanolamide*[6] | 2.0 | 1.0 |
| C-1 | 13.4 | 4.8 | — | — | 2.75 |
| C-2 | 13.4 | 5.8 | — | — | 2.25 |
| C-3 | 12.4 | 6.8 | — | — | 1.83 |
| C-4 | 11.4 | 7.8 | — | — | 1.33 |

*[1]Emsorb 2502 (Emery Industries, Inc.)
*[2]Armac HT (Armak Industrial Chemicals Div., Akzona, Inc.)
*[3]Armeen T (Armak Industrial Chemicals Div., Akzona, Inc.)
*[4]Armeen C (Armak Industiral Chemicals Div., Akzona, Inc.)
*[5]Emid 6545 (Emery Industries, Inc.)
*[6]Witcamide AL69-58 (Witco chemical Corp.)

TABLE II

| Sample Example No. | Weight of No. 2 Fuel Oil, (g) | Weight of Sorbitan Sesquioleate, (g)*[1] | N—Containing Surfactant | Weight, (g) | Time For Emulsion To Appear (Min.) |
|---|---|---|---|---|---|
| S-11 | 333 | 115 | oleylamine*[7] | 46 | ¼ |
| S-12 | 333 | 115 | oleylamine*[8] | 46 | ¼ |
| S-13 | 333 | 115 | oleic diethanolamide*[5] | 46 | 1 |
| C-5 | 333 | 161 | none | — | 13 |

*[1]Emsorb 2502 (Emery Industries, Inc.)
*[5]Emid 6545 (Emery Industries, Inc.)
*[7]Armeen OL (Armak Industrial Chemicals Div., Akzona, Inc.)
*[8]Armeen OL (Armak Industrial Chemicals Div., Akzona, Inc.)

EXAMPLE 3

Sample 13 obtained in accordance with Example 2 is admixed with 153 g. Microperl™ GT-25**** perlite and packed in polyethylene bags, stored for 85 days at 40° F. (4.4° C.) and thereafter detonated at 40° F. with a 500 g. pentolite primer to obtain a detonation rate of 5400 m/second and a measured specific energy content of $8.2\times10^5$ ft lb/lb (588 cal/g). The minimum primer for this composition is 25 g. PETN at 40° F., 150 g. pentolite at 0° F.

****Trademark of Grefco, Inc.

EXAMPLE 4

Three test emulsions identified as S-14, C-6 and C-7 are prepared as in Example 1, the C-6 and C-7 samples being control samples individually using cocoamine and sorbitan sesquioleate emulsifier components, which are combined as the emulsifier of S-14. The emulsion formation time is noted in each case and the relative stability of the resulting emulsions determined after seven days by using a conical shaped Penetrometer*; the combined results are recorded in Table III infra.

*Precision Scientific Company

TABLE III

| Sample | Emulsifier(s) | Weight (g.) | Penetrometer Penetration (mm) | Emulsion Appearance Time (minutes) |
|---|---|---|---|---|
| S-14 | Cocoamine | 2.0 | 12 | 0.1 |
| | Sorbitan Sesquioleate | 4.8 | | |
| C-6 | Cocoamine | 4.8 | 40* | 0.2 |
| C-7 | Sorbitan Sesquioleate | 4.8 | 10 | 2.6 |

*A reading of 25 or greater denotes unsatisfactory stability.

What is claimed is:

1. In a process for forming an invert emulsion blasting agent obtained by admixing (a) an oil phase containing a sorbitan fatty acid ester emulsifier in a hydrocarbon solvent, and (b) an aqueous phase containing at least one water soluble inorganic oxidizer salt; the improvement comprising modifying the blasting agent by precombining said sorbitan ester emulsifier with an active amount of a nitrogen-containing surfactant selected from the group consisting of a fatty acid amide, a fatty acid amine and corresponding salts thereof, in which the hydrocarbon group of the nitrogen-containing surfactant is a straight chain having about 10–20 carbon atoms.

2. The process of claim 1 wherein the sorbitan fatty acid ester emulsifier is a member selected from the group consisting of sorbitan sesquioleate, sorbitan laurate, sorbitan oleate, sorbitan palmitate, and sorbitan stearate; and said hydrocarbon solvent comprises one or more of a normal or branched aliphatic, alicyclic or aromatic hydrocarbon.

3. The process of claim 1 wherein the aqueous phase of the blasting agent comprises about 5–30 weight percent water containing at least one oxidizer salt selected from the group consisting of ammonium nitrate, sodium chlorate, sodium perchlorate, calcium nitrate, calcium chlorate, calcium perchlorate, potassium nitrate, potassium chlorate, potassium perchlorate, ammonium chlorate, ammonium perchlorate, lithium nitrate, lithium chlorate, lithium perchlorate, magnesium nitrate, magnesium chlorate, aluminum chlorate, barium nitrate, barium chlorate, barium perchlorate, zinc nitrate, zinc chlorate and zinc perchlorate.

4. The process of claim 2 wherein the emulsifier is present in an invert emulsion blasting agent in an amount of about 0.6–7.0 weight percent or higher, and the nitrogen-containing surfactant component comprises not less than about 0.1 weight percent based on total invert emulsion blasting agent.

5. The process of claim 4 wherein the nitrogen-containing surfactant is a member selected from the group consisting of hydrogenated tallowamine, dodecylamine, cocoamine, coco monoethanolamide, coco diethanolamide, linoleic diethanolamide, oleic diethanolamide, stearic diethanolamide and corresponding salts thereof.

6. The process of claim 5 wherein the nitrogen containing surfactant is dodecylamine or salt thereof.

7. The process of claim 5 wherein the nitrogen containing surfactant is a hydrogenated tallowamine or salt thereof.

8. The process of claim 5 wherein the nitrogen containing surfactant is oleylamine or salt thereof.

9. The process of claim 5 wherein the nitrogen containing surfactant is cocoamine or salt thereof.

10. The process of claim 5 wherein the nitrogen containing surfactant is coco monoethanolamide or salt thereof.

11. The process of claim 5 wherein the nitrogen containing surfactant is coco diethanolamide or salt thereof.

12. The process of claim 1 wherein the nitrogen containing surfactant is linoleic diethanolamide or salt thereof.

13. The process of claim 5 wherein the nitrogen containing surfactant is oleic diethanolamide or salt thereof.

14. The process of claim 5 wherein the nitrogen containing surfactant is stearic diethanolamide or salt thereof.

15. An emulsifier system comprising in combination, (A) at least one sorbitan fatty acid ester;

(B) an active amount of at least one nitrogen-containing surfactant; and (C) a normal or branched hydrocarbon, an alicyclic hydrocarbon or an aromatic hydrocarbon; the ratio by weight of (A)-to-(B) being about 10–1 to 0.1–1.0.

16. The composition of claim 15 wherein the (A) component is sorbitan sesquioleate, sorbitan laurate, sorbitan oleate, sorbitan palmitate, or sorbitan stearate; and the (B) component is a fatty acid amide, a fatty acid amine, or corresponding salts thereof in which the hydrocarbon group thereof is a straight chain of about 10–20 carbon atoms.

17. The composition of claim 16 wherein the (B) component is dodecylamine or salt thereof.

18. The composition of claim 16 wherein the (B) component is a hydrogenated tallowamine or salt thereof.

19. The composition of claim 16 wherein the (B) component is oleylamine or salt thereof.

20. The composition of claim 16 wherein the (B) component is cocoamine or salt thereof.

21. The composition of claim 16 wherein the (B) component is coco monoethanolamide.

22. The composition of claim 16 wherein the (B) component is coco diethanolamide.

23. The composition of claim 16 wherein the (B) component is linoleic diethanolamide.

24. The composition of claim 16 wherein the (B) component is oleic diethanolamide.

25. The composition of claim 16 wherein the (B) component is stearic diethanolamide.

* * * * *